United States Patent [19]

Henderson et al.

[11] Patent Number: 4,807,705

[45] Date of Patent: Feb. 28, 1989

[54] CASING HANGER WITH LANDING SHOULDER SEAL INSERT

[75] Inventors: Herman O. Henderson, Aberdeen, Scotland; Joseph H. Hynes, Houston, Tex.

[73] Assignee: Cameron Iron Works USA, Inc., Houston, Tex.

[21] Appl. No.: 96,133

[22] Filed: Sep. 11, 1987

[51] Int. Cl.[4] ..... E21B 33/043; E21B 33/047

[52] U.S. Cl. ..... 166/348; 166/85; 166/208; 285/143

[58] Field of Search ..... 166/348, 208, 382, 182, 166/206, 207, 85; 285/140, 143, 391

[56] References Cited

U.S. PATENT DOCUMENTS

| | | | |
|---|---|---|---|
| 3,273,915 | 9/1966 | Bishop et al. | 285/140 X |
| 4,138,144 | 2/1979 | Pierce, Jr. | 285/143 X |
| 4,289,206 | 9/1981 | Kirkland | 166/348 |
| 4,353,420 | 10/1982 | Miller | 166/382 |
| 4,488,740 | 12/1984 | Baugh et al. | 285/84 |
| 4,550,782 | 11/1985 | Lawson | 166/382 |
| 4,595,063 | 6/1986 | Jennings et al. | 166/382 |
| 4,597,448 | 7/1986 | Baugh | 166/348 |
| 4,615,544 | 10/1986 | Baugh | 285/18 |

*Primary Examiner*—Hoang C. Dang
*Attorney, Agent, or Firm*—Vinson & Elkins

[57] ABSTRACT

A subsea wellhead housing for an underwater well has a small, integral landing shoulder in the bore for supporting an intermediate casing string. The small landing shoulder permits passage of a standard 17½ inch drill bit. Breech block teeth are provided in the wellhead housing bore above the small landing shoulder for attaching a separately installable landing shoulder insert. The breech block teeth also permit passage of a standard 17½ inch drill bit. An intermediate casing hanger is landed on the small, integral shoulder, and the landing shoulder insert installed in the wellhead housing. The landing shoulder insert has a skirt at its lower end which is received in and sealed against the upper end of the hanger. The upper end of the landing shoulder insert is sealed against the wellhead housing bore. In one embodiment, the hanger for 17 inch casing is fluted on its outer surface to pass through breech block slots in the wellhead housing bore in order to reach its landing shoulder. In another embodiment, the breech block profile is bored out to allow passage therethrough of a 16 inch casing hanger to reach its landing shoulder without rotationally orienting the hanger with respect to the wellhead. In all embodiments, pressure end load from internal wellhead pressure is transferred to the housing by the breech block teeth between the housing and the landing shoulder insert. The small, integral landing shoulder thereby supports only the intermediate casing string weight.

15 Claims, 6 Drawing Sheets

CASING HANGER WITH LANDING SHOULDER SEAL INSERT

BACKGROUND OF THE INVENTION

The present invention is generally related to subsea wellhead systems, and more particularly to a casing hanger for suspending an intermediate casing string from a subsea wellhead housing, and a separately installable landing shoulder insert or support member for supporting progressively smaller sized casing strings within the intermediate string and for sealingly isolating the intermediate casing string hanger from internal fluid pressure in the subsea wellhead housing.

In the past, subsea wellhead systems have been known and used in the drilling of underwater wells for the production of oil and gas which utilize a separately installable landing shoulder insert or support member for multiple concentric casing strings and hangers in order to allow full bore access, without underreaming, below the wellhead housing for a standard 17½ inch drill bit prior to installation of the multiple concentric casing strings. The multiple concentric casing strings, or surface casing, may be, for example, 13⅜ inch, 9⅝ inch, and 7-inch strings, all supported on the landing shoulder insert attached to the wellhead housing and concentrically disposed within a conductor casing string, typically a 20-inch string welded to the bottom of the wellhead housing. It has also been proposed that such a separately installable landing shoulder serve as a hanger for an intermediate casing string, such as a 16-inch string, between the 20-inch conductor casing and the 13⅜ inch casing. Examples of subsea wellhead systems such as the foregoing are disclosed in U.S. Pat. No. 4,615,544, issued Oct. 7, 1986, which is incorporated in its entirety herein by reference.

At times, it may be necessary or desirable, due to formation conditions or other factors, to install and cement an intermediate casing, such as a 17-inch or a 16-inch casing, for example, in the well prior to running the separately installable landing shoulder into the wellhead. In order to do so, however, according to past practice the wellhead would have to have an integral landing shoulder which would be large enough to support the weight of the intermediate casing hanger and string, as well as pressure end loads resulting from internal fluid pressure in the wellhead housing. The potential pressure end loads might be, for example, as much as eight times the casing weight. Such an integral shoulder would have to extend far enough into the wellhead bore to provide sufficient bearing area for the intermediate casing weight and pressure end load, so as to restrict the bore and prevent passage therethrough of the standard 17½. inch drill bit. In that event, underreaming would be required below the wellhead housing, thereby negating one of the primary advantages of the separately installable landing shoulder insert.

SUMMARY OF THE INVENTION

The present invention provides a subsea wellhead housing for an underwater well having a relatively small, integral landing shoulder in the bore which has enough bearing area for supporting the weight of an intermediate casing hanger and casing string thereon, but yet does not extend into the wellhead bore a distance sufficient to restrict access below the wellhead housing for a standard 17½ inch drill bit. The wellhead housing is provided with connecting means in the bore, such as a plurality of groupings of breech block teeth, above the small landing shoulder for attaching thereto the correlatively shaped connecting means of a separately installable landing shoulder insert or support member. The connecting means of the wellhead bore also permit passage therethrough of a standard 17½ inch drill bit.

An intermediate casing hanger, suspending an intermediate casing string, is landed on the small, integral shoulder in the wellhead bore. After the intermediate casing string is cemented in the well bore, the landing shoulder insert is run into the wellhead and attached to the connecting means in the bore. The landing shoulder insert or support member has a downwardly extending skirt which is sealingly received in a counterbore in the upper end of the intermediate casing hanger. The upper end of the landing shoulder insert or support member is sealingly engaged with the wall of the wellhead housing bore. Thus, the intermediate casing hanger and its small, integral support shoulder are sealingly isolated from internal fluid pressures in the wellhead housing. Pressure end loads, resulting from such internal fluid pressures, are transferred to the wellhead housing by the connecting means between the insert or support member and the wellhead housing, e.g., by the breech block teeth.

In one embodiment of the invention, the small integral shoulder is adapted for suspending therefrom the weight of a 17-inch casing string between the 20-inch conductor casing and the 13⅜ inch casing. The intermediate casing hanger is fluted on its upper outer surface so that it can be oriented with the breech block profile in the wellhead bore and passed therethrough in order to reach its small landing shoulder.

In another embodiment of the invention, the small integral shoulder is adapted for suspending therefrom the weight of a 16-inch casing string between the 20-inch conductor casing and the 13⅜ inch casing. The bore of the wellhead housing at the breech block profile is bored out slightly to allow passage of the 16-inch casing hanger through the wellhead housing to land on its small landing shoulder without the need to rotationally orient the hanger with respect to the wellhead housing. The bearing area of the bored-out breech block profile is still adequate, however, to support the casing and pressure loads experienced in service.

BRIEF DESCRIPTION OF THE DRAWINGS

For a detailed description of the preferred embodiment of the present invention, reference will now be made to the accompanying drawings wherein.

DETAILED DESCRIPTION OF THE PREFERRED EMBODIMENT

The present invention is directed to a subsea casing hanger and breech block seal insert for a subsea wellhead system. Reference is made to FIG. 1 and FIGS. 2A, 2B, 2C, 5A, 5B, and 5C of U.S. Pat. No. 4,615,544 for a disclosure of the general environment of the casing hanger and breech block seal insert of the present invention. Although the present invention may be used in a variety of environments, FIG. 1 of the present application is a diagrammatic illustration of a typical installation of a casing hanger and a casing string of the present invention in a wellhead disposed on the ocean floor of an offshore well.

Figure 1:
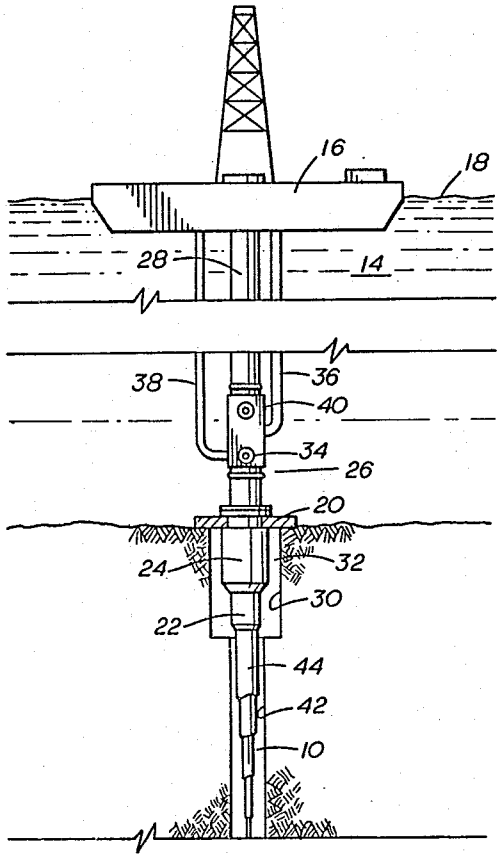
FIG. 1 is a diagrammatic illustration of a typical installation of a casing hanger and a casing string in a wellhead of the present invention disposed on the ocean floor of an offshore well.

Referring initially to FIG. 1, there is shown a well bore 10 drilled into the sea floor 12 below a body of water 14 from a drilling vessel 16 floating at the surface 18 of the water. A base structure or guide base 20, a conductor casing 22, a wellhead (one embodiment being designated as 24 and another as 24*a* herein), a blowout preventer stack 26 with pressure control equipment, and a marine riser 28 are lowered from floating drilling vessel 16 and installed into sea floor 12. Conductor casing 22 may be driven or jetted into the sea floor 12 until wellhead 24, 24*a* rests near sea floor 12, or as shown in FIG. 1, a bore hole 30 may be drilled for the insertion of conductor casing 22. Guide base 20 is secured about the upper end of conductor casing 22 on sea floor 12, and conductor casing 22 is anchored within bore hole 30 by a column 32 of cement about a substantial portion of its length. Blowout preventer stack 26 is releasably connected through a suitable connection to wellhead 24, 24*a* and includes one or more blowout preventers such as blowout preventer 40. Such blowout preventers include a number of sealing pipe rams, such as pipe rams 34 on blowout preventer 40, adapted to be actuated to and from the blowout preventer housing into and out of sealing engagement with a tubular member, such as drill pipe, extending through blowout preventer 40, as is well known. Marine riser pipe 28 extends from the top of blowout preventer stack 26 to floating vessel 16.

Blowout preventer stack 26 includes "choke and kill" lines 36, 38, respectively, extending to the surface 18. Choke and kill lines 6, 38 are used, for example, to test pipe rams 34 of blowout preventer 40. In testing rams 34, a test plug is run into the well through riser 28 to seal off the well at the wellhead 24, 24*a*. The rams 34 are activated and closed, and pressure is then applied through kill line 38 with a valve on choke line 36 closed to test pipe rams 34.

Drilling apparatus, including drill pipe with a standard 17½ inch drill bit, is lowered through riser 28 and conductor casing 22 to drill a deeper hole 42 in the ocean bottom for an intermediate casing string, one such string being a 17-inch string 44 and another such string being a 16-inch string 44*a*. A hanger for intermediate casing string 44, 44*a*, one embodiment of which is shown at 50 in FIG. 2 and another embodiment of which is shown at 50*a* in FIGS. 3, 4, 5, and 6 of the present application, is lowered through riser 28 with intermediate casing string 44, 44*a* suspended therefrom until the hanger 50, 50*a* lands in the wellhead 24, 24*a* as hereinafter described. A separately installable landing shoulder insert or support member, one embodiment of which is shown at 52 in FIG. 2 and another embodiment of which is shown at 52*a* in FIGS. 4, 5, 6, and 7 of the present application, is lowered into and connected to wellhead 24, 24*a* and sealed with respect to casing hanger 50, 50*a* and wellhead 24, 24*a* as hereinafter described. A surface casing hanger 54 (FIG. 2), shown suspending surface casing 56, is lowered through riser 28 until hanger 54 lands on support member 52 or 52*a*, as the case may be, and is connected to wellhead 24, 24*a*. Other interior casing and tubing strings are subsequently landed and suspended in wellhead 24, 24*a* according to known practice.

Figure 2:
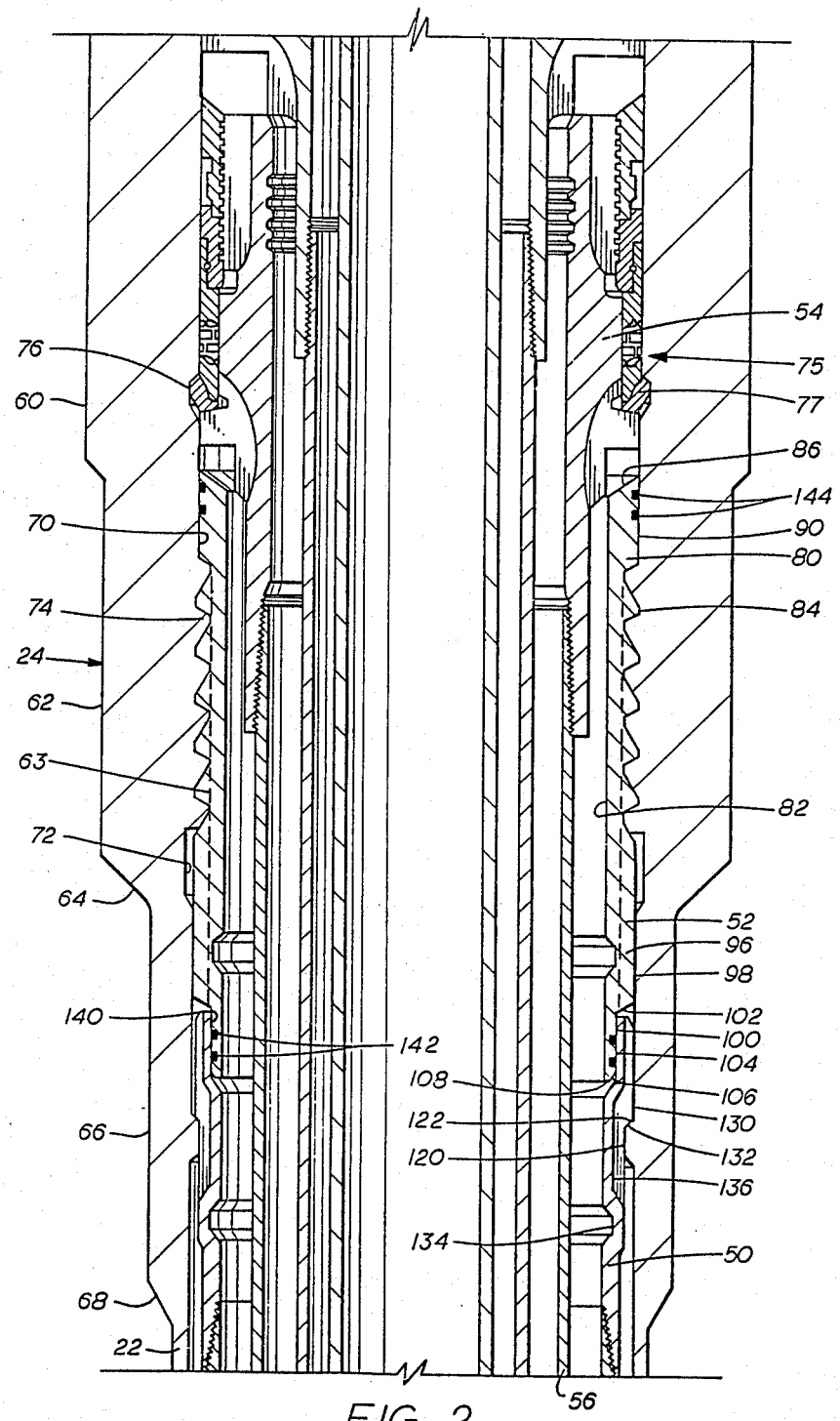
FIG. 2 is a fragmentary, vertical cross-sectional view of one embodiment of a wellhead having installed therewithin a landing shoulder insert or support member and an intermediate casing hanger of the present invention, with the next smaller size casing string suspended from a conventional hanger disposed on the landing shoulder insert.

Referring now to FIG. 2, wellhead 24 includes a housing 60 having a reduced diameter lower end 62 with a downwardly facing, downwardly and inwardly tapering conical shoulder 64 at its lower end. Reduced diameter lower end 62 has a further reduced tubular portion 66 at its terminus with another smaller downwardly facing, downwardly and inwardly tapering conical shoulder 68 at its lower end. Conductor casing 22 is typically 20-inch outside diameter (O.D.) pipe and is attached, e.g., by welding, to reduced tubular portion 66 on the bottom of wellhead 24. Conductor casing 22 typically has a thickness of about ½ inch and about a 19-inch inner diameter (I.D.) internal bore.

Disposed on the interior of the internal bore 70 of wellhead 24 are a plurality of stop notches 72, breech block teeth 74, and a plurality of annular grooves spaced along bore 70 above breech block teeth 74, one such groove being shown at 76. Groove 76 is provided for locking hanger 54 to wellhead 24 by means of an expandable lock ring 77. Lock ring 77 is actuated when a seal assembly 75 of hanger 54 is moved downwardly to energize the seal. Breech block teeth 74 have an I.D. of approximately 17 9/16 inches to permit the passage therethrough of a standard 17½ inch drill bit.

Landing shoulder insert or support member 52 may be, for example, a breech block insert adapted for lowering into bore 70 and connecting to breech block teeth 74. Breech block insert 52 includes a solid annular tubular body 80 having a smooth interior bore 82, exterior breech block teeth 84 adapted for engagement with interior breech block teeth 74 on wellhead 24, an upwardly facing, downwardly and inwardly tapering conical seat or support shoulder 86 for engaging and supporting surface casing hanger 54, and a key assembly (not shown) for engaging one of the stop notches 72 for locking breech block insert 52 against further rotation within wellhead housing 60.

Breech block insert 52 preferably includes a plurality of groupings of segmented teeth 84 with breech block slots or spaces therebetween for receiving corresponding groupings of segmented teeth 74 in wellhead housing 60. Segmented teeth 74, 84 are preferably no-lead teeth, but they may have leads. Teeth 74 in wellhead housing 60 are tapered downwardly and inwardly to facilitate passage of the drill bit. Teeth 84 on breech block insert 52 have corresponding tapers to matingly engage wellhead teeth 74. The groupings of teeth 74, 84 each preferably include six rows of segmented teeth approximately ½ inch thick from base to face. A continuous upper annular flange 90 on breech block insert 52 above teeth 84 limits the insertion of the tooth groupings on the insert 52 into the spaces between the tooth groupings on the wellhead housing 60. Continuous upper annular flange 90 thus provides a stop for limiting the downward travel of insert 52 into wellhead 24. The lowermost tooth segment on insert 52 is oversized to prevent a premature rotation of insert 52 within wellhead 24 until flange 90 lands on the uppermost surface of tooth segments 74.

By having six groupings of teeth 74, 84, the teeth may be interconnected by rotating insert member 52 through 30°, i.e., 180° divided by the number of groupings. Segmented teeth 74, 84 may merely be portions of circular grooves having slots or spaces therebetween for interconnecting them. The taper of segmented teeth 74, 84 is greater than 30° and preferably is about 55° whereby the thread area is substantially increased to withstand a greater amount of shear stress. This tooth profile attempts to substantially equalize the stresses over all of the segmented teeth 74, 84 so that they do not tend to yield one at a time. The segmented teeth 84 tend to clean segmented teeth 74 as breech block insert 52 is rotated within wellhead 24, knocking any debris off the teeth so that the debris drops into the breech block slots or spaces between the groups of teeth.

Although the embodiments of the landing shoulder insert depicted herein are of the breech block type, it should be understood that the present invention is not limited to such a construction. The breech block construction does have some advantages over other types of connections and may be viewed as preferred, but such other types of connections, such as continuous threads on the interior bore of the wellhead and on the exterior wall of the landing shoulder insert, may also be used with the present invention. One advantage of the breech block construction over continuous threads, for example, is the need to rotate through only 30° to fully engage teeth 74, 84. In addition, use of breech block teeth provides a clear indication of when the insert member 52 is fully engaged with the wellhead. As insert member 52 is lowered into wellhead 24, the lowermost tooth segment on insert member 52 will engage the uppermost tooth segment on the wellhead housing 60. Insert member 52 is then rotated less than 30° with respect to the wellhead to permit the tooth segments on one to pass along the slots or spaces between the tooth segments on the other. This drop is substantial, for example up to 12 inches, and can easily be sensed at the surface to insure that insert member 52 has landed in wellhead 24 and can be rotated into breech block engagement.

Below the breech block teeth 84, body 80 of insert member 52 includes an annular, tubular lower body portion 96 with a fluted exterior surface 98. Body 80 of insert member 52 below flange 90 includes longitudinally extending flutes or passageways 63, shown in phantom lines in FIG. 2, for receiving the breech block teeth of the wellhead 24 as the insert member 52 is lowered into position in the wellhead housing 60. Passageways 63 may include, for example, the spaces or slots between the breech block teeth 84, and a plurality of circumferentially spaced slots through body 80 below the breech block slots. Lower body portion 96 carries thereon a key assembly (not shown) including an outwardly biased dog slidingly housed in an outwardly facing cavity. The dog is biased outwardly by springs, for example, disposed between its radially inner surface and the inner end wall of the cavity in which it is disposed, and is positioned so that when the insert member 52 is fully landed in wellhead 24 and fully rotationally engaged, the dog will expand into one of the notches 72 to thereby stop rotation of insert member 52.

Below lower body portion 96 of insert member 52 is disposed a reduced outside diameter end portion or skirt 100, with a downwardly facing, downwardly and inwardly tapering conical shoulder 102 therebetween. Skirt 100 has a smooth exterior surface 104 and a downwardly facing, downwardly and inwardly tapering conical shoulder 106 on its lower portion terminating at the bottom end 108 of insert member 52. An annular groove 110 is disposed in the bore 82 of lower body portion 96 of insert member 52 for engagement by a running tool for lowering insert member 52 into the wellhead.

Below and spaced axially from the notches 72, the interior bore of wellhead 24 includes an inwardly projecting annular support flange 120 having an upwardly facing, downwardly and inwardly tapering shoulder surface 122 for supporting intermediate casing hanger 50. The upper exterior surface of casing hanger 50 is fluted so that it can be lowered through the breech block teeth 74 of wellhead 24 and landed on shoulder 122. The outwardly projecting portions 130 of casing hanger 50 each have a downwardly facing, downwardly and inwardly tapering shoulder 132 for engaging the correlatively shaped surface of shoulder 122. The projecting portions 130 of casing hanger 50 pass along the slots or spaces between the groupings of teeth 74 in wellhead 24 when hanger 50 is lowered into the wellhead, until hanger 50 comes to rest on support shoulder 122. The outside diameter of projecting portions 130 is slightly less than the inside diameter of the wellhead housing bore 70 to permit lowering of hanger 50 through housing 60. An annular groove 134 is disposed around the interior bore of hanger 50 for engagement with a running tool or the like for lowering hanger 50 into the wellhead. When hanger 50 is lowered into wellhead 24, some rotational orientation may be necessary to ensure that the projecting portions 130 are properly aligned with the slots between the breech block teeth 74, so that hanger 50 can pass downwardly through the teeth 74.

The exterior surface of hanger 50 is provided with a plurality of circumferentially disposed flutes 136 extending around, i.e. from below to above, support flange 120 in order to permit mud return flowby for cementing operations. Flutes 136 may be, for example, in fluid communication with the spaces between projecting portions 130 on the upper exterior surface of hanger 50, which permit passage of the breech block teeth 74 of wellhead 24 therethrough when hanger 50 is lowered into the well.

The landing shoulder 122, when mated with the fluted outer diameter profile of the hanger 50, provides sufficient support area to support the weight of the intermediate casing string 44 while still not restricting the wellhead bore and thereby permitting full bore access below wellhead 24 for drilling operations, but not enough support area to support the pressure end load on hanger 50 when the subsea housing 24 is subjected to internal fluid pressure. For an 18¾ inch, 15,000 psi working pressure wellhead such as that shown in FIG. 2, for example, and with intermediate casing 44 being a 17-inch outer diameter string, for example, the support area of mating shoulders 122, 132 will be approximately 8 to 10 square inches.

In order to isolate hanger 50 from exposure to this pressure end load and thereby permit hanger 50 to be adequately supported, with the 8-to-10 square-inch mating area supporting the casing weight only, the interior surface of hanger 50 is sealed to the exterior surface of skirt 100 of insert member 52, and the exterior surface of insert member 52 is sealed to the interior surface of wellhead bore 70. Skirt 100 of insert member 52 is telescopingly received within the smooth internal bore 140 of the upper end of hanger 50, and is fluid pressure sealed against bore 140 by a pair of seal members 142 carried in annular grooves around the exterior surface of skirt 100. Seal members 142 may be, for example, O-ring seals. Tapering shoulder 106 on the lower end of skirt 100 eases the insertion of skirt 100 into bore 140. Seal members 144, which may also be O-ring seals, carried in annular grooves around the upper exterior periphery of insert member 52 provide a fluid pressure tight seal between insert member 52 and wellhead 24. Seal members 142, 144 may be elastomeric seals, for example, but other types of seals may be used as long as they provide a fluid pressure-tight seal to isolate hanger 50 from internal wellhead pressure. In the embodiment of the invention disclosed in FIG. 2, pressure end load, created by internal pressure within the subsea housing 60, is transferred to the housing by the multi-tooth breech block insert 52, which is capable of handling this large load. As stated previously, insert member 52 may be connected to housing 60 by means other than mating breech block teeth 74, 84, and in that event such alternative connecting means must also be selected in order to provide sufficient support area between insert member 52 and housing 60 for insert member 52 to adequately support both the weight of the hangers and casing strings which it is intended to support, and the pressure end loads experienced in service.

Figure 3:
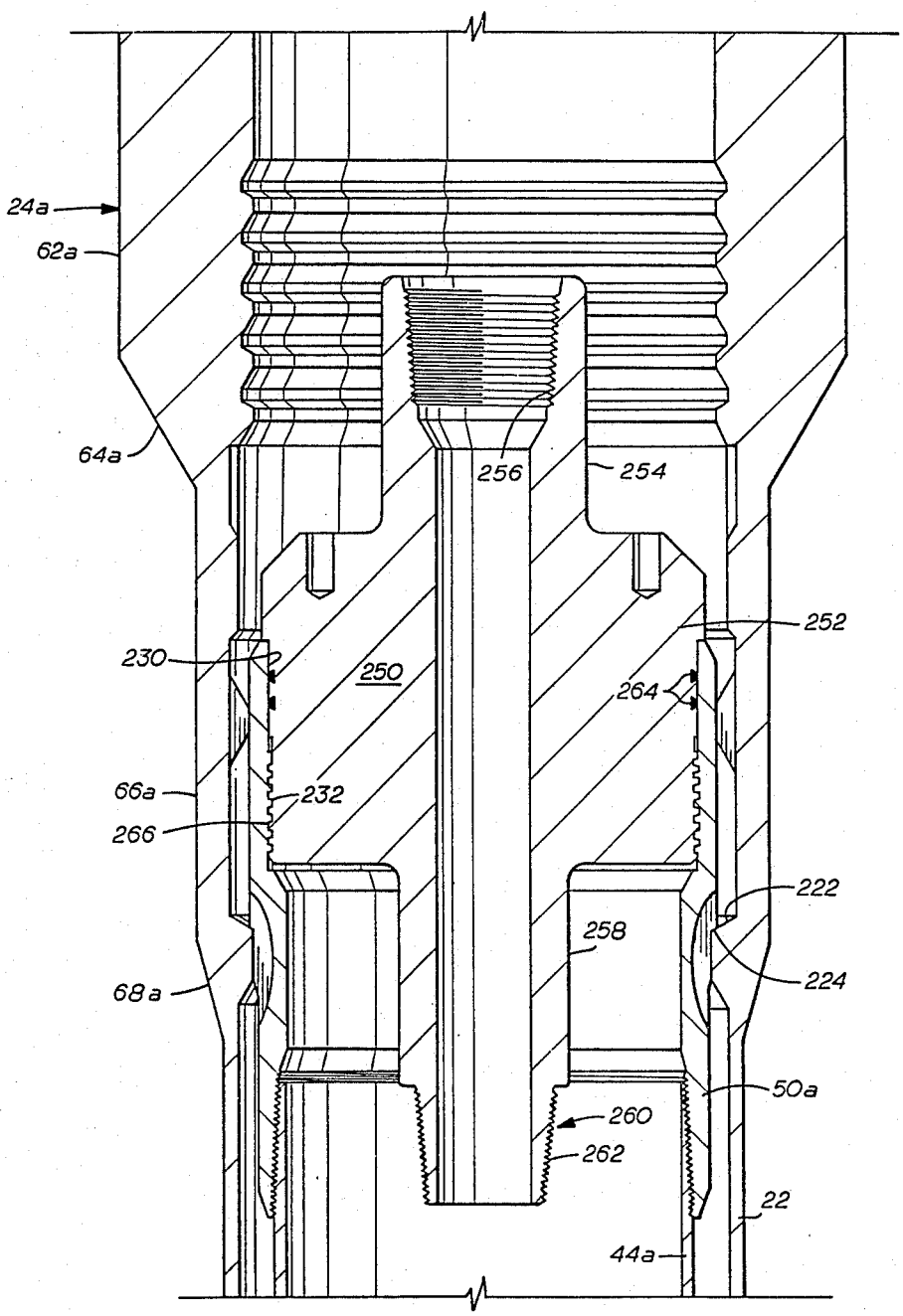
FIG. 3 is a fragmentary, vertical cross-sectional view of an alternative embodiment of a wellhead and an intermediate casing hanger of the present invention being installed on its small landing shoulder in the wellhead by a drill pipe running tool.
Figure 4:
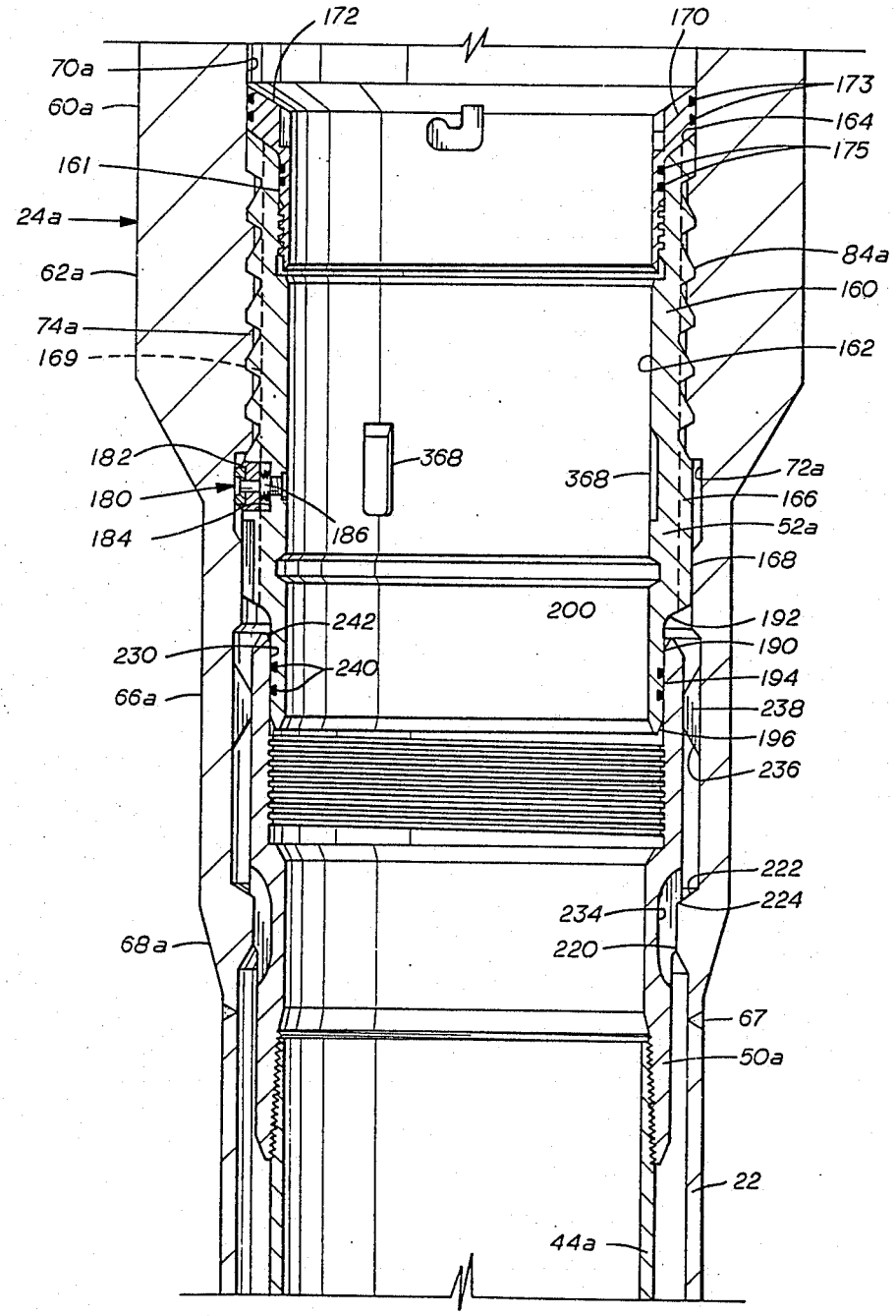
FIG. 4 is a fragmentary, vertical cross-sectional view of the wellhead and casing hanger of FIG. 3, with the corresponding embodiment of the landing shoulder insert or support member of the present invention also installed in the wellhead.

Referring now to FIGS. 3, 4, 5, 6, and 7, and initially, in particular, to FIG. 4, another embodiment of the apparatus of the present invention is disclosed. Wellhead **24*a* includes a housing 60*a* having a reduced diameter lower end 62*a* with a downwardly facing, downwardly and inwardly tapering conical shoulder 64*a* at its lower end. Reduced diameter lower end 62*a* has a further reduced tubular portion 66*a* at its lower end with another smaller downwardly facing, downwardly and inwardly tapering conical shoulder 68*a* at its lower end. Conductor casing 22 is attached, e.g. by weld 67, to reduced tubular portion 66*a***.

Disposed on the interior of the internal bore **70*a* of wellhead 24*a* are a plurality of stop notches 72*a*, breech block teeth 74*a*, and a plurality of annular locking grooves (not shown) spaced along bore 70*a*, like groove 76 shown in FIG. 2, above breech block teeth 74*a*. Breech block teeth 74*a* are generally similar to teeth 74 illustrated in FIG. 2, but have been bored out to provide a slightly larger internal diameter than teeth 74 to permit installation of hanger 50*a* in wellhead 24*a* without having to first orient hanger 50*a* with respect to teeth 74*a***, as is described hereinafter.

Landing shoulder insert or support member **52*a* may also be, for example, a breech block insert adapted for lowering into bore 70*a* and connecting to breech block teeth 74*a*. Breech block insert 52*a* includes a solid annular tubular body 160 having a smooth interior bore 162, exterior breech block teeth 84*a* adapted for engagement with interior breech block teeth 74*a* on wellhead 24*a*, and a packoff ring 170. Teeth 84*a* are substantially the same as breech block teeth 84 described with respect to FIG. 2. Body 160 has an upwardly facing, downwardly and inwardly tapering conical seat or support shoulder 164 adapted for engagement with packoff ring 170**.

Below the breech block teeth **84*a*, body 160 of insert member 52*a* includes an annular, tubular lower body portion 166 with a fluted exterior surface 168. Lower body portion 166 carries thereon a key assembly 180 including an outwardly biased dog 182 slidingly house in an outwardly facing cavity 184. The dog is biased outwardly by springs 186, and is positioned so that when the insert member 52*a* is fully landed in wellhead 24*a* and fully rotationally engaged, the dog 182 will expand into one of the notches 72*a* to thereby stop rotation of insert member 52*a***.

The upper portion of body 160 includes a counterbore 161 for receiving the pin end 171 of packoff ring 170. Packoff ring 170 includes external threads for threaded engagement with the internal threads in counterbore 161 of body 160. Packoff ring 170 includes an upwardly facing support shoulder 172 for engagement with the downwardly facing shoulder of a casing hanger, such as casing hanger 54 (FIG. 2), suspending the next smaller size casing string within intermediate casing **44*a*. Seal members such as, for example, O-rings 173 are housed in annular grooves around the upper outer surface of packoff ring 170 for sealing engagement with the bore wall 70*a* of wellhead 24*a*. Packoff ring 170 also includes seal members 175, which may also be O-ring seals, housed in annular grooves around the pin end 171 of ring 170 above its threads for sealing engagement with the wall of counterbore 161 of body 160**.

Figure 7:
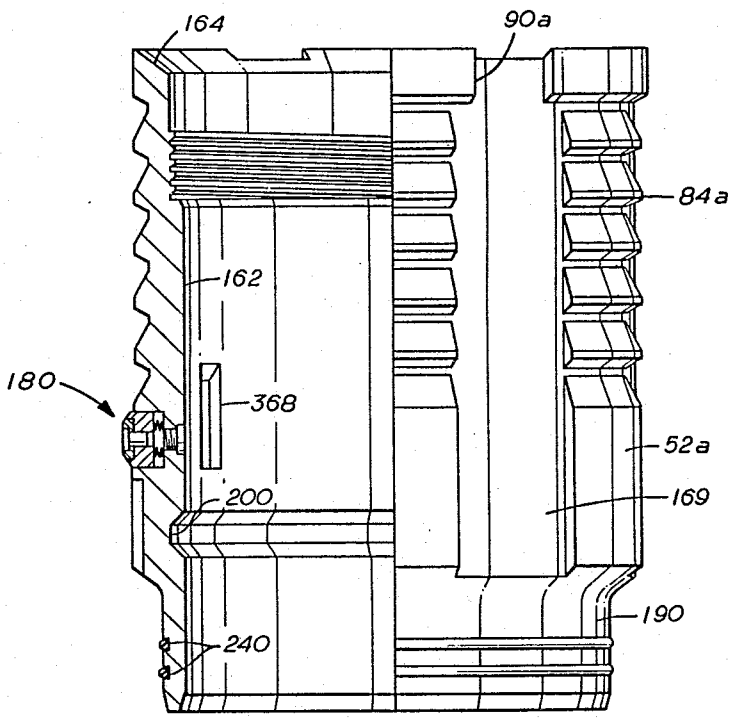
FIG. 7 is a view partly in section and partly in elevation of the embodiment of the landing shoulder insert or support member of the present invention shown in FIG. 4.

Tubular body 160 of insert member **52*a* includes longitudinally extending flutes or passageways 169, shown in FIG. 7 and in phantom lines in FIG. 4, for receiving the breech block teeth of the wellhead 24*a* as the insert member 52*a* is lowered into position in the wellhead housing 60*a*. Passageways 169 may include, for example, the spaces or slots between the breech block teeth, and a plurality of circumferentially spaced slots through body 160 above and below the breech block slots. Passageways 169 are narrower at their upper ends, as shown at 90*a* in FIG. 7, in order to provide a support surface for insert member 52*a* to land on the uppermost tooth segment 74*a* in wellhead housing 60*a***.

Below lower body portion 166 of insert member **52*a* is disposed a reduced outside diameter end portion or skirt 190, with a downwardly facing, downwardly and inwardly tapering curved shoulder surface 192 therebetween. Skirt 190 has a smooth exterior surface 194 and a downwardly facing, downwardly and inwardly tapering conical shoulder 196 on its lower portion terminating at the bottom end 198 of insert member 52*a*. An annular groove 200 is disposed in the bore 162 of lower body portion 166 of insert member 52*a* for engagement by a running tool as hereinafter described for lowering insert member 52** into the wellhead.

Below and spaced axially from the notches **72*a*, the interior bore of wellhead 24*a* includes an inwardly projecting annular support flange 220 having an upwardly facing, downwardly and inwardly tapering shoulder surface 222 for supporting intermediate casing hanger 50***a*. The exterior surface of casing hanger 50*a* at about its mid-portion is provided with a downwardly facing shoulder surface 224, shaped correlatively to shoulder surface 222, for mating engagement with shoulder surface 222. When hanger 50*a* is lowered into wellhead 24*a* -, shoulder surface 224 comes to rest on support shoulder surface 222. The outside diameter of the upper portion of hanger 50*a* above shoulder 224 is greater than that below shoulder 224, and is less than the inside diameter of the wellhead housing bore at breech block teeth 74*a*to permit lowering of hanger 50*a* through housing 60*a* to its landing shoulder without the necessity of rotationally orienting hanger 50*a* with respect to the wellhead housing. The upper end of hanger 50*a* is provided with a counterbore 230 having internal threads 232 around its periphery for engagement with a running tool for lowering hanger 50*a* into the wellhead, as described further hereinafter.

The exterior of hanger 50*a* is provided with a plurality of circumferentially disposed flutes 234 extending around, i.e. from below to above, support flange 220 in order to permit flowby for cementing operations. The interior of reduced tubular portion 66*a* of wellhead 24*a* has a plurality of circumferentially disposed, inwardly projecting spline-like members 236 for providing alignment or centering and stabilizing means for the upper exterior surface of casing hanger 50*a*, which facilitates the telescoping insertion of skirt 190 into counterbore 230 and the effecting of a seal between them. Flutes or passageways 238 are disposed between the inwardly projecting members 236 to permit flow-by for cementing operations.

The landing shoulder 222, when mated with shoulder 224 of hanger 50*a*, provides sufficient support area to support the weight of the intermediate casing string 44*a* while still not unduly restricting the wellhead bore and thereby permitting full bore access below wellhead 24*a* for drilling operations, but not enough bearing area to support pressure end load on hanger 50*a* when the subsea housing 24*a* is subjected to internal fluid pressure. For an 18¾ inch, 15,000 psi working pressure wellhead such as that shown in FIG. 4, for example, and with intermediate casing 44*a* being a 16-inch outer diameter string, for example, the minimum support area of mating shoulders 222, 224 will be about 6.22 square inches, which is adequate for the weight of 16-inch casing. Shoulder 224, which carries casing weight only and no pressure end load, may be rated, for example, to carry a 565,000 lb. load, which is greater than the expected 16-inch casing weight.

In order to isolate hanger 50*a* from exposure to pressure end load, the interior surface of hanger 50*a* is sealed against the exterior surface of skirt 190 of insert member 52*a*, and packoff ring 170 seals insert member 52*a* against the interior surface of wellhead bore 70*a* by means of seals 173 as described previously. Also as described previously, seal members 175 provide a seal between packoff ring 170 and insert member 52*a*. Skirt 190 of insert member 52*a* is telescopingly received within the smooth internal surface of counterbore 230 of hanger 50*a*, and is fluid pressure sealed against counterbore 230 by a pair of seal members 240 carried in annular grooves around the exterior surface of skirt 190. Seal members 240 may be, for example, O-ring seals. Around the upper end of counterbore 230 there is disposed an upwardly facing, downwardly and inwardly tapering conical shoulder 242. Conical shoulder 242 and tapering shoulder 196 on the lower end of skirt 190 ease the insertion of skirt 190 into counterbore 230 when insert member 52*a*. is installed in wellhead 24*a*. Like seal members 142, 144, seal members 240, 173, 175 may be elastomeric seals, but other types of suitable seal members may be used as long as they serve to isolate hanger 50*a* from pressure end loads due to internal fluid pressure in subsea housing 60*a*. In the embodiment of the invention illustrated in FIG. 4, such pressure end load is transferred to housing 60*a* by the multi-tooth breech block insert 52*a*, which is capable of handling this large load. Similarly to the embodiment shown in FIG. 2, insert 52*a* may be connected to housing 60*a* by means other than mating breech block teeth 74*a*, 84*a*, and in that event such alternative connecting means must also be selected in order to provide sufficient support area between insert member 52*a* and housing 60*a* for insert member 52*a* to adequately support both the weight of the hangers and casing strings which it is intended to support, and the pressure end loads experienced in service.

As stated previously, breech block teeth 74*a* are substantially similar to teeth 74 shown in FIG. 2, but the breech profile of the wellhead 24*a* shown in FIG. 4 has been bored out to increase the inside diameter of the wellhead at the breech block teeth 74*a* over the inside diameter of the wellhead shown in FIG. 2 at teeth 74. For example, the breech profile of the wellhead shown in FIG. 2 has an inside diameter of about 17.562 inches or approximately 17 9/16 inches, but that shown in FIG. 4 has been bored out to an inside diameter of about 17.920 inches. As a result, the radial depth of teeth 74*a* is less than the radial depth of teeth 74, and the total bearing area of the teeth 74*a* is reduced accordingly. For example, the total bearing area of teeth 74 for an 18¾ inch, 15,000 psi working pressure wellhead 24 is about 86 square inches, but the total bearing area of teeth 74*a* in the bored-out breech profile of wellhead 24*a* is reduced to a minimum of about 56.25 square inches, which is still adequate to support the casing weight and pressure loads expected to be encountered in service. Other than being bored out to increase the inside diameter over that shown in FIG. 2, the breech block profile of FIG. 4 is substantially the same as that shown in FIG. 2.

The maximum outside diameter of casing hanger 50*a*, i.e. the diameter above the shoulder 224, is about 17.890 inches. Therefore, the hanger 50*a* can be lowered through the bored-out breech profile of the wellhead 24*a* shown in FIG. 4, which again has a minimum inside diameter of about 17.920 inches, without being rotationally oriented with respect to the breech block slots of the wellhead. The minimum bore through the wellhead housing 60*a* is about 17.562 inches at support flange 220, which will allow the passage of a standard 17½ inch drill bit. This minimum bore through wellhead housing 60*a* below the breech profile helps to prevent damage to the profile when tools are being pulled out of the hole, since it helps to prevent the tools from impacting sharply from side to side against the walls of the wellhead housing and the breech profile during such pullout operations. The minimum inside diameter of bore 162 of insert member 52*a* is about 15.250 inches, and the minimum bore through hanger 50*a*, which in the embodiment shown in FIG. 4 is a 16-inch hanger, is about 15.060 inches. The flow-by passages 234, 238 each have a minimum total area of about 13.50 square inches and can accommodate flow-by of a particle having a maximum outside diameter of about 0.72 inches.

Referring now to FIG. 3, there is shown an example of a running tool 250 for running casing hanger 50*a* into the wellhead 24*a* on, for example, 6⅝ inch drill pipe (not shown). Running tool 250 includes a generally tubular cylindrical body 252 having an upstanding box end 254 with internal threads 256 therein for threaded attachment to the pin end of a joint of drill pipe. A reduced diameter lower extension 258 of body 252 has a pin end 260 with external threads 262 thereon, adapted for threaded attachment to the box end of another joint of drill pipe. Body 252 of running tool 250 is received within counterbore 230 of hanger 50*a* and is sealed against the smooth upper wall of counterbore 230 above threads 232 by seal members 264, which may be O-ring seals, for example. Body 252 is provided with external threads 266 around its periphery below seal members 264 for threaded engagement with threads 232 in counterbore 230. Threads 266, 232 may be, for example, 16⅜ inch diameter, 2 pitch, left hand stub Acme threads. After running tool 250 with hanger 50*a* attached is lowered into the wellhead 24*a* and shoulder 224 lands on shoulder 222, and after any cementing operations for casing 44*a* are complete, the running tool 250 can be disengaged from hanger 50*a* by right-hand rotation of the drill string. Running tool 250 can then be removed from the well, and insert member 52*a* installed.

Figure 5:
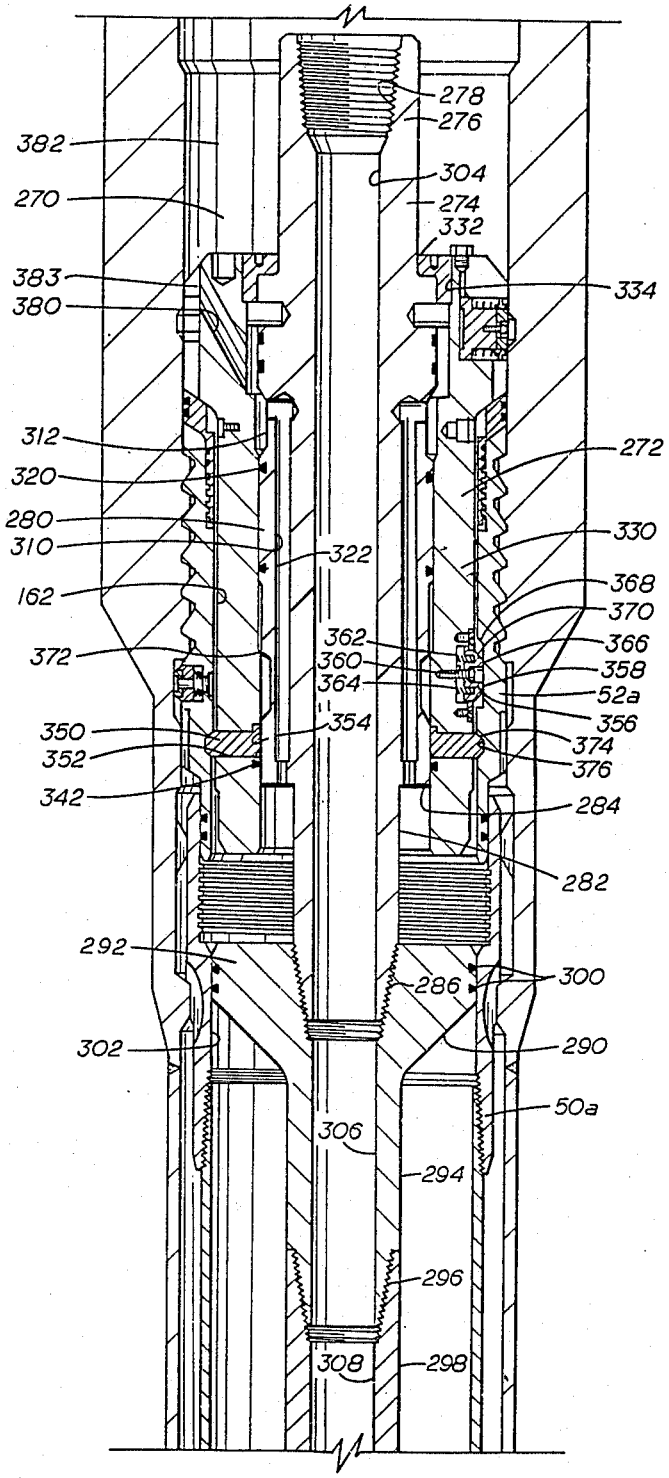
FIG. 5 is a fragmentary, vertical cross-sectional view of a running tool for installing the embodiment of the landing shoulder insert or support member shown in FIG. 4, with the mandrel of the running tool in its upper or running-in position.
Figure 6:
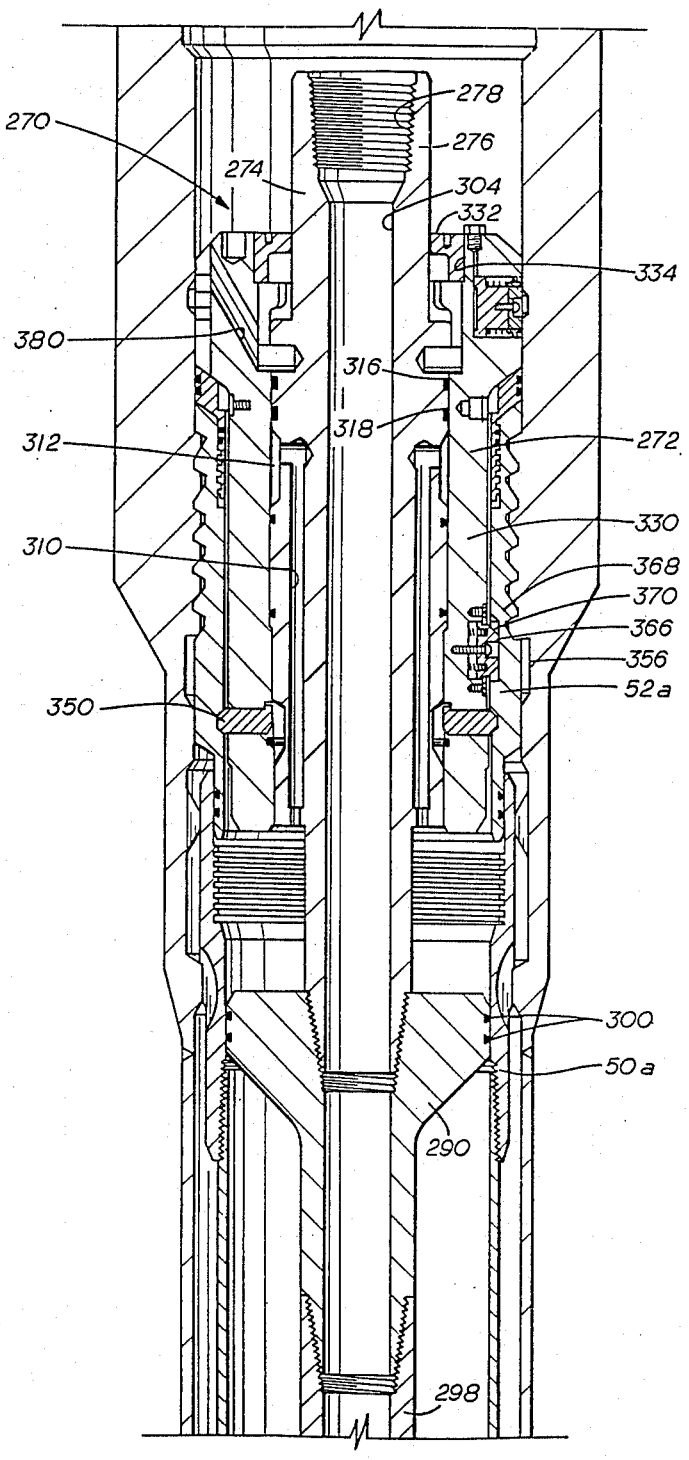
FIG. 6 is a fragmentary, vertical cross-sectional view of the running tool shown in FIG. 5, with the mandrel of the running tool in its lower position, ready to be lifted and released from the insert or support member.

Referring now to FIGS. 5 and 6, there is shown an example of a running tool 270 which can be used for running the insert member 52*a* into wellhead 24*a* and testing all seals at one time. Running tool 270 generally includes an outer barrel 272 and an axially movable mandrel 274 therewithin. Mandrel 274 is movable between an upper, or running in, position wherein the insert member 52*a* is attached to the running tool for lowering into wellhead 24*a*, and a lower, or released, position wherein the running tool is disengaged from the insert member after it has been landed in the wellhead for retrieval of the running tool to the surface. The upper or running in position is illustrated in FIG. 5, and the lower or released position is shown in FIG. 6.

Referring now to FIG. 5, mandrel 274 includes an upstanding upper box end 276 having internal threads 278 for threaded attachment to the pin end of a joint of drill pipe. Below box end 276, mandrel 274 includes a generally tubular cylindrical body 280 having a reduced diameter, downwardly extending lower pin end 282 forming an annular shoulder 284. Lower pin end 282 of mandrel body 280 has external threads thereon for threaded engagement, as shown at 286, with the internal box threads of a test sub 290. Test sub 290 has an upper flange body 292 and a reduced diameter lower tubular portion 294 below body 292, with a lower pin end 296 with exterior threads thereon for threaded engagement with the box threads of a drill pipe joint 298. Upper flange body 292 of test sub 290 carries thereon a pair of seal members 300, which may be O-ring seals, for sealing against the smooth bore wall 302 of hanger 50*a*. The seal provided by seal members 300 is a sliding seal, and is effective in both the upper and the lower positions of mandrel 274. Mandrel 274 has an internal central bore 304 therethrough which is coaxial with internal central bore 306 of test sub 290 and, of course, the bores of the drill pipe above and below the running tool, such as bore 308 of pipe joint 298.

Body 280 of mandrel 274 has a plurality of longitudinally extending passageways 310 therein which are in fluid communication at their upper ends 311 with an annular groove 312 around the exterior surface of the mandrel body. The lower ends 314 of passageways 310 exit at face 284 of mandrel body 280. Mandrel body 280 carries seal members 316, 318, 320, 322, which may be O-ring seals, in annular grooves in its outer surface for sealing between mandrel 274 and outer barrel 272. Seals 316, 318 provide a seal when the mandrel is in its lower position (FIG. 6).

Outer barrel 272 includes a generally tubular cylindrical body 330 closed on its upper end by a cap member 332 threaded into a counterbore 334 in body 330. Body 330 carries a seal member 342, which may be an O-ring seal, in an annular groove around its inner periphery for sealing against the outer wall of body 280 above shoulder 284 when the mandrel 274 is in its upper position (FIG. 5).

Outer barrel 272 carries a plurality of circumferentially spaced, radially inwardly slidable dogs 350 in radially extending openings 352 in outer barrel 272. In the upper or running in position of mandrel 274, dogs 350 are held by the adjacent portion 354 of mandrel body 280 in their radially outermost positions in engagement with groove 200 in insert member 52*a* for locking the running tool 270 to insert member 52*a* for lowering it into the wellhead. Outer barrel 272 also carries a plurality of circumferentially spaced key assemblies 356 in its outer wall for antirotationally latching barrel 272 to insert member 52*a* to permit rotation of the insert member 52*a* through the drill string and the mandrel and outer barrel of the running tool after insert member 52*a* has been landed, in order to engage the breech block teeth of the insert member with the breech block teeth of the wellhead 24*a*. Key assemblies 356 include key members 358 disposed in slots 360 in outer barrel 272, and biased outwardly by springs 362, 364. The nose 366 of each of the key members extends into a slot 368 in the bore wall 162 of insert member 52*a* when the insert member 52*a* is un into the well. When the running tool is lifted for removal to the surface, a conical shoulder 370 on each of the key members 358 engages the upper surface of slots 368 and cams the key members inwardly and out of slots 368.

Body 280 of mandrel 274 is provided with a plurality of slots or windows 372 above mandrel body portion 354 and which are adjacent dogs 350 when mandrel 274 is in its lower position. Dogs 350 have conical cam surfaces 374 for engagement with the correlatively shaped surface 376 of slot 200 to cam dogs 350 radially inwardly and into slots 372 when the running tool is lifted for retrieval to the surface after insert member 52*a* is installed.

At the upper end portion of outer barrel 272, a passageway 380 extends obliquely through the wall of the barrel body and communicates with annulus 382 through a slot 383 in the barrel body at its upper end, and with groove 312 and, thus, passageway 310, at its lower end when the mandrel 274 is in its upper position as shown in FIG. 5. Passageway 380, 312, 310 enables fluid pressure from the annulus to be applied to the seals between insert member 52*a* and hanger 50*a* with the rams of the blowout preventer closed in order to test those seals, since test sub 290 also provides a seal 300 with the hanger 50*a*. At the same time, pressure is applied from the annulus to the seal between packoff ring 170 and wellhead 24*a* in order to test that seal as well. The pressure end load generated during testing (pressure × area of seals 300) is transferred to the insert member 52*a* and not the shoulder 224 of hanger 50*a*.

When the mandrel 274 and outer barrel 272 are made up at the surface and latched to insert member 52*a*, mandrel 274 is antirotationally engaged with outer barrel 272 in order to permit rotation of the outer barrel through the drill string and mandrel to in turn rotate the insert member and engage its breech block teeth with those of wellhead 24*a*. Such antirotational engagement may be effected by shear-pinning the mandrel to the barrel, for example. After the insert member has been landed and lockingly engaged to wellhead 24*a*, further rotation of insert member 52*a* is prevented by key assembly 180. Since the barrel is antirotationally locked to the insert member by the key assemblies 356, further rotation of the drill string will shear the pin between mandrel 274 and barrel 272, and permit the mandrel to rotate with respect to the barrel. The mandrel and barrel may be provided with pin and J-slot means or the like, for example, so that further rotation of the mandrel will cause the mandrel to fall to its lowered or released position (FIG. 6) wherein the dogs 350 may be cammed into slots 372 for retrieval of the running tool to the surface. Means are also provided to maintain the relative axial positions of the mandrel and outer barrel in order to prevent re-engagement of the dogs 350 with groove 200 upon the running tool's being lifted.

Because many varying and different embodiments may be made within the scope of the inventors' concept taught herein, and because many modifications may be made in the embodiments herein detailed, it should be understood that the details set forth herein are to be interpreted as illustrative and not in a limiting sense. Thus, it should be understood that the invention is not restricted to the illustrated and described embodiments, but can be modified within the scope of the following claims.

We claim:

1. Apparatus for suspending an intermediate casing string from a wellhead housing in an underwater well, for suspending at least one other casing string from the wellhead housing within the intermediate casing string, comprising:

a wellhead housing having a body, said body having a bore therethrough and breech block connecting means disposed therein;

a relatively small shoulder disposed on the wall of the wellhead housing bore below the connecting means and having a minimum bearing area sufficient to support the weight of an intermediate casing string;

a casing hanger having a body, said body having a bore therethrough and means disposed thereon for attaching the hanger to the intermediate casing string, and means for landing on the relatively small shoulder for suspending the hanger from the wall of the wellhead housing bore;

a landing shoulder insert having a body, said body having breech block connecting means thereon for engagement with the connecting means on the wall of said wellhead housing bore, a support shoulder means for supporting a second casing string within the intermediate casing string, first sealing means disposed on said body in sealing engagement with the wall of the wellhead housing bore and the landing shoulder insert body and a second sealing means in sealing engagement with the casing hanger bore and the landing shoulder insert body for sealingly isolating the casing hanger from fluid pressure inside the wellhead housing.

2. Apparatus according to claim 1, wherein said body of said landing shoulder insert has an annular skirt disposed around its lower end and telescopingly received in said bore of said casing hanger, said second sealing means being disposed between and sealingly engaged against said skirt and said casing hanger bore.

3. Apparatus according to claim 1, wherein the connecting means in the wellhead housing has sufficient bearing area to support the weight of the casing strings to be supported on the landing shoulder insert and the pressure end loads from such fluid pressure inside the wellhead housing, and both such connecting means and the relatively small shoulder therebelow permit the passage of a standard 17½ inch drill bit through the wellhead housing.

4. Apparatus according to claim 1, wherein the wellhead housing bore wall is provided with a plurality of circumferentially spaced apart groupings of breech block teeth, and the landing shoulder insert body has disposed thereon a corresponding number of circumferentially spaced apart groupings of breech block teeth for engagement with the wellhead teeth, said body of said casing hanger being larger in outside diameter than the inside diameter of the wellhead housing at its breech block teeth, said casing hanger body having a plurality of circumferentially spaced apart flutes above its landing means to permit passage of the breech block teeth on the wellhead housing along said flutes when said casing hanger is lowered to land on the relatively small shoulder on the wall of the wellhead housing.

5. Apparatus according to claim 4 wherein the relatively small landing shoulder has an inside diameter which is greater than the inside diameter of the wellhead housing at its breech block teeth.

6. Apparatus according to claim 5, wherein the intermediate casing is 17-inch outer diameter casing, and the relatively small shoulder has a bearing area of between about 8 square inches to about 10 square inches.

7. Apparatus according to claim 4, wherein said casing hanger body has disposed therein a plurality of circumferentially spaced apart flowby passage means for permitting flowby of mud returns around said relatively small landing shoulder when said casing hanger is landed thereon.

8. Apparatus according to claim 1, wherein the wellhead housing bore wall is provided with a bored-out breech block profile including a plurality of circumferentially spaced apart groupings of breech block teeth, and the landing shoulder insert body has disposed thereon a corresponding number of circumferentially spaced apart groupings of breech block teeth for engagement with the wellhead teeth, the teeth on said wellhead housing being shorter in radial depth than the teeth on said landing shoulder insert, said body of said casing hanger being smaller in outside diameter than the inside diameter of the wellhead housing at its breech block teeth, said relatively small shoulder being smaller in inside diameter than the inside diameter of the wellhead housing at its breech block teeth.

9. Apparatus according to claim 8, wherein the intermediate casing is 16-inch outer diameter casing, and the relatively small shoulder has a minimum bearing area of about 6.22 square inches.

10. Apparatus according to claim 8, wherein the bored-out breech block profile of the wellhead housing has a minimum bearing area of about 56.25 square inches.

11. Apparatus according to claim 8, wherein said casing hanger body has disposed therein a plurality of circumferentially spaced apart flowby passage means for permitting flowby of mud returns around said relatively small landing shoulder when said casing hanger is landed thereon.

12. Apparatus according to claim 11, wherein the wall of the wellhead housing bore above the relatively small landing shoulder has disposed thereon a radially inwardly extending flange for engaging and supporting the upper end of the casing hanger centrally within the wellhead housing bore, said flange being provided with a second plurality of circumferentially spaced apart flowby passage means for permitting flowby of mud returns past said flange.

13. Apparatus according to claim 8, wherein said casing hanger body has a counterbore in its upper end and running tool attaching means around the inner periphery of said counterbore for attaching said casing hanger to a running tool for lowering the casing hanger into the well.

14. Apparatus according to claim 13, wherein said running tool attaching means includes a left hand thread.

15. Apparatus according to claim 8, wherein said landing shoulder insert body has a bore therethrough, and said first sealing means includes a packoff ring attached to the upper end of the landing shoulder insert body, an upper seal member sealingly engaged between the packoff ring and the wall of the wellhead housing bore, and a lower seal member sealingly engaged between the packoff ring and the bore of the landing shoulder insert body.

* * * * *